United States Patent [19]

Cluff

[11] Patent Number: 4,725,044

[45] Date of Patent: Feb. 16, 1988

[54] CHAIN LINK FENCING CONTAINING DECORATIVE SLATS AND LOCKING CLIPS

[76] Inventor: Robert G. Cluff, 4983 Cahoon Cir., Taylorsville, Utah 84118

[21] Appl. No.: 931,845

[22] Filed: Nov. 18, 1986

[51] Int. Cl.[4] ..... B21F 27/00

[52] U.S. Cl. ..... 256/34; 256/35; 245/11

[58] Field of Search ..... 256/34, 35; 245/11

[56] References Cited

U.S. PATENT DOCUMENTS

| | | | |
|---|---|---|---|
| 2,760,759 | 8/1956 | Rice | 256/34 |
| 2,802,645 | 8/1957 | Rice | 256/34 |
| 3,037,593 | 6/1962 | Webster | 256/24 X |
| 3,069,142 | 12/1962 | Kessler | 256/34 |
| 3,285,577 | 11/1966 | Pinson | 256/34 |
| 3,572,640 | 3/1971 | Vecchiarelli | 256/34 |
| 3,712,590 | 1/1973 | Tochner et al. | 256/34 |
| 3,913,889 | 10/1975 | Nugent | 256/34 X |
| 4,085,954 | 4/1978 | Thompson | 256/34 |
| 4,512,556 | 4/1985 | Meglino | 256/34 |
| 4,570,906 | 2/1986 | Walden | 256/34 |

FOREIGN PATENT DOCUMENTS

| | | | |
|---|---|---|---|
| 192058 | 10/1964 | Sweden | 256/34 |

*Primary Examiner*—Andrew V. Kundrat

*Attorney, Agent, or Firm*—Thorpe, North & Western

[57] ABSTRACT

In a chain link fence having a plurality of elongate slats woven through the links of the chain link fabric, an improved system for locking and retaining the slats in the chain link fabric comprises an elongate clip member which is received in locking interengagement in a receptacle or opening in the respective slat. The clip member can be of the type which simply extends from the sides of the slat to form an obstruction with the links in the fence such that the slats cannot be removed from the fence. Alternatively, the clip members can be adapted to extend from the slat to a bottom rail so as to lock the slats to the bottom rail such that the slats cannot be removed from the fence.

16 Claims, 12 Drawing Figures

CHAIN LINK FENCING CONTAINING DECORATIVE SLATS AND LOCKING CLIPS

BACKGROUND OF THE INVENTION

1. Field

This invention relates to chain link fences which have a plurality of decorative, elongate slats woven through the links of the chain link fabric of the fence. More particularly, the present invention relates to improved means for locking and retaining the slats in a uniform position along the fencing. Further, the present invention relates to an improved lower rail element upon which the slats can be supported, with the slats being attachable to the lower rail using novel clip means.

2. State of the Art

It is well known to insert slats in chain link fences to provide privacy and to improve the appearance of the fence. Unfortunately, there are two somewhat related serious problems encountered in using slats in chain link fencing, first, the slats have a tendency to shift longitudinally after being inserted in the wire fabric of the chain link fence so as to become disarranged and uneven. Disarranged, uneven slats greatly impairs the appearance of the fence. The second related problem is that the loosely positioned slats are easy prey for vandals. The slats are unfortunately, easily removed from the fence and discarded by the vandals.

Several methods have been proposed to alleviate these problems. The slats have been secured to the chain links in the fence by using staples, nails and other fasteners. In addition systems have been proposed for interlocking the slats with channel members or elongate rigid connecting members which run along the length of the fence and which engage the slat members. The installation of such systems is a tedious, time consuming, costly operation. No inexpensive, expedient means have been proposed to effectively cope with the vandalism problem. Some of the more complex systems do alleviate the vandalism problem, but unfortunately as stated previously, these systems generally are costly and require tedious time consuming installation. Representative U.S. patents which have been directed to retaining slats in position in chain link fences are:

| | | |
|---|---|---|
| 2,760,759 | 3,037,593 | 4,085,954 |
| 2,802,645 | 3,069,142 | 4,512,556 |

3. Objective

A principal objective of the present invention is to provide a new and improved slat system comprising novel, unique, inexpensive, easily installed clip means for retaining the slats at a uniform position along the fencing and locking the slats into the fence to thwart vandalism.

SUMMARY OF THE INVENTION

The above objective is achieved in accordance with the present invention by providing a chain link fence of the type including a plurality of elongate slats woven flatwise through the links of the chain link fabric of the fence in spaced, parallel arrangement. The slats preferably have a hollow, flattened, tubular shape whereby the slats comprise a pair of generally flat, spaced apart sides facing each other, with the two sides being joined along mutually respective lateral edges by curved edge walls which together with the sidewalls form a substantially enclosed, elongate space within the slat. The enclosed space defined by the walls of the slat is generally open only at the ends of the elongate slat.

In one preferred embodiment of the present invention, each of the slats is provided with a receptacle formed at a uniform position in each slat, generally within close vicinity, i.e., one to three inches, of the end of the slat which is positioned at the bottom of the fence. The receptacle is preferably formed by a cut out opening in opposite sides of the slat so that the openings are in alignment.

An elongate clip and lock member is provided for each receptacle in the respective slats. The clip and lock member is received longitudinally within the receptacle and extends from at least one side of the slat. The elongate clip and lock member thus forms a lock pin which extends from the slat and obstructs the chain link fencing if the slat containing the lock pin is moved upwardly or downwardly in the chain link fencing. The slats are accordingly locked into the chain link fencing at a uniform position along the fencing. The slats cannot be removed without a concerted effort. Thus, problems caused by vandals or mischievous children removing slats from the fencing is essentially eliminated.

In another preferred embodiment of the present invention, a bottom rail is threaded through the chain link fabric so as to lie along the bottom edge of the fencing. The slats are woven through the chain link fabric in spaced, parallel, arrangement to extend from the top of the fence to the rail at the bottom of the fence. The bottom ends of the slats abut the bottom rail so that the slats are positioned uniformly along the length of the fence. Each slat has a receptacle formed therein adjacent to the end of slat which abuts the rail at the bottom of the fence.

An elongate clip and lock member is provided for each receptacle in the respective slats, with the clip and lock member being adapted to be interengaged between the slat and the rail. Each slat is thus tied to the rail through the interengaging clip and lock member. In one embodiment, the clip and lock member encircles the rail and the two ends of the clip and lock member engage the receptacle in the slat. The clip and lock member thus encircles the rail and locks the slat in place from upward movement away from the rail. In another embodiment, one end of the clip and lock member interengages and interlocks with the receptacle in the slat and the other end of the clip and lock member interengages and interlocks with respective interlocking means on the rail. Again, the slat is locked in place from upward movement away from the rail.

Additional objects and features of the present invention will become apparent from the following detailed description, taken together with the accompanying drawings.

THE DRAWINGS

Preferred embodiments of the present invention representing the best modes presently contemplated of carrying out the invention are illustrated in the accompanying drawings, in which FIG. 1 is a fragmentary view in elevation of a portion of chain link fencing incorporating one novel embodiment of means in accordance with the present invention for locking the slats within the chain link fabric of the fence;

DETAILED DESCRIPTIONS OF THE PREFERRED EMBODIMENTS

Figure 1:
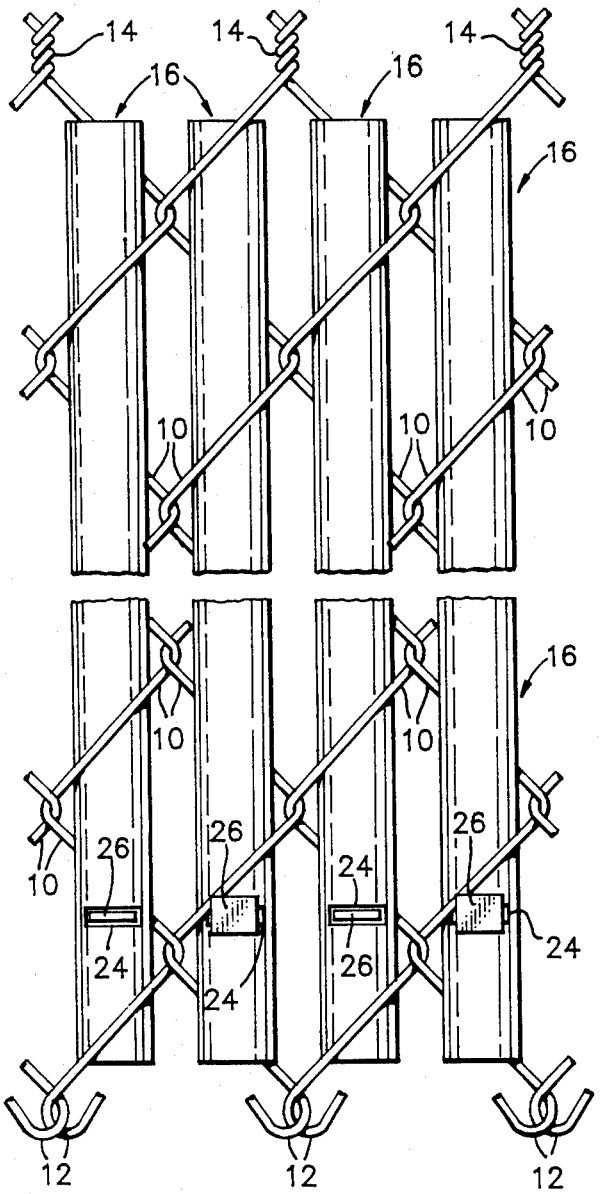

Several preferred embodiments of the slat retaining system of the present invention are shown in the drawings and will be described hereinafter. Like parts in the various figures of the drawings will be identified with the same reference numbers.

The present invention involves an improvement in conventional chain link fencing in which elongate wires are bent in zig-zag manner and interlocked one with another to form a chain link fabric comprising a plurality of links 10. The bottom ends of adjacent wires of the chain link fabric may be interconnected by reversely bent end portions 12, and the upper ends of adjacent wires are interconnected by twisting the upper portions together. The twisted upper portions 14 present rather sharp barbs which discourage attempts to climb over the fence. It is the preference of some, however, to invert the chain link fabric so as to place the twisted end portions 14 at the bottom.

A plurality of elongate slats 16 are provided, with the slats 16 being woven flatwise through the links 10 of the chain link fabric. The slats 16 are disposed in spaced, parallel relationship. In the illustrated embodiments, the slats 16 are woven through the chain links 10 so as to extend vertically relative to the fence. The slats 16 may be made of plastic, wood or metal. In accordance with this invention, novel improved slats 16 are provided together with novel means for retaining the slats 16 in uniform positions along the fencing as well as physically locking the slats in the chain link fencing such that the slats cannot be removed or otherwise subject to vandalism.

Figure 5:
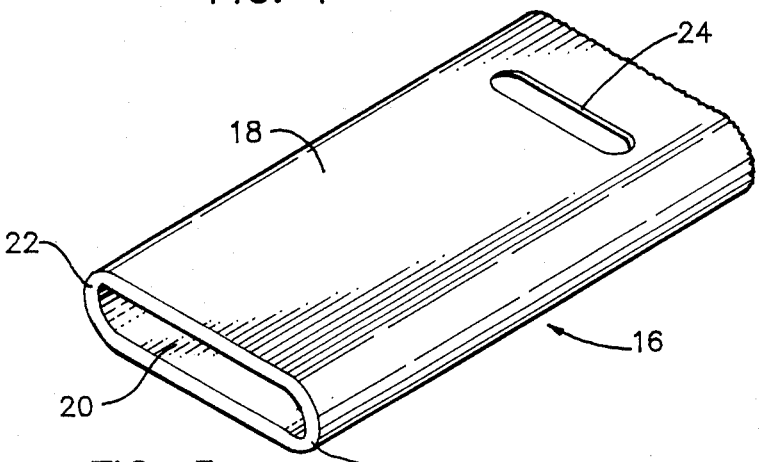
FIG. 5 is a pictorial view of the bottom end portion of the slats of FIG. 1 showing the receptacle for the elongate clip and lock member.
Figure 12:
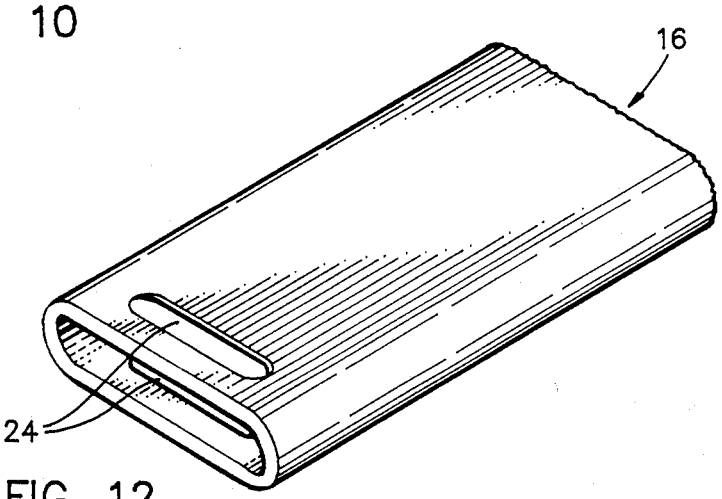
FIG. 12 is a pictorial view of the bottom end portion of the slats of FIG. 10 showing the receptacle for the elongate clip and lock member.

Preferably, the slats 16 are made of a plastic material and are formed so as to have a flattened, tubular shape as best illustrated in FIGS. 5 and 12. Such slats 16 have essentially flat front and back sides or faces 18 and 20, respectively, which are spaced apart, with the sides or faces 18 and 20 being substantially parallel to each other and in longitudinal alignment with each other. The sides 18 and 20 are joined along mutually respective lateral edges by curved end walls 22 to complete the elongate, tubular shape. An elongate space is enclosed within the tubular slats 16, with the space being generally open only at the ends of the slats 16.

In accordance with the present invention, an improvement is provided in the means for retaining the slats 16 at uniform positions and for securely locking the slats in the chain link fabric so as to prevent the slats 16 from being removed from the fencing by vandals. In one preferred embodiment shown in FIGS. 1–5 of the drawings, the improved means for retaining and locking the slats 16 in the fencing comprises a receptacle 24 formed at a uniform position in each of the slats 16. The receptacle 24 is advantageously located near the end of the slat 16 which when inserted in the fencing fabric is at either the bottom or top of the fencing. Preferably, the receptacle is positioned at a distance of from about an inch to three inches from the end of the slat 16. The receptacle is preferably in the form of elongate openings cut in the front and back faces 18 and 20 of the slat 16 such that the openings 24 are in alignment with each other. As will become apparent from the following discussion, the openings 24 could have other shapes such as circular, oval, square, rectangular, etc.

Figure 2:
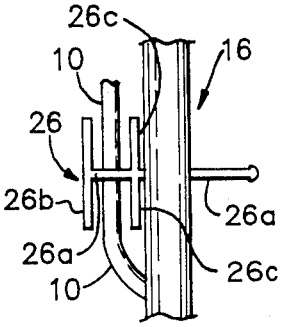
FIG. 2 is a partial view in elevation taken along line 2—2 of FIG. 1 showing a slat and an elongate clip and lock member.
Figure 3:
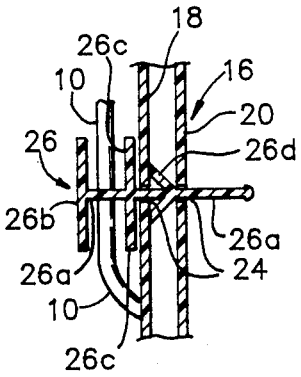
FIG. 3 is a cross-section of the slat and elongate clip and lock member of FIG. 2 as taken along line 3—3 of FIG. 1.
Figure 4:
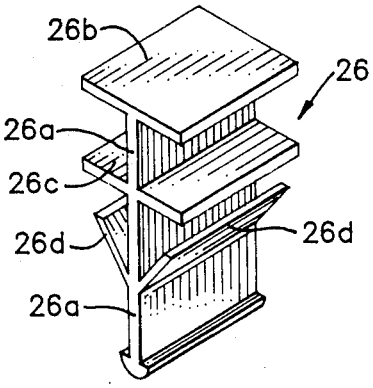
FIG. 4 is a pictorial view of the elongate clip and lock member of FIGS. 1–3.

The improved means for retaining and locking the slats 16 in the fencing as shown in FIGS. 1–5 further comprises elongate clip and lock members 26 which engage mutually respective receptacles 24 in the slats 16. The clip and lock members 26 extend from at least one side of the slat 16 so that they form a lock pin which sticks out and forms an obstruction to obstruct the links 10 in the chain link fencing whenever the slat 16 is moved upwardly or downwardly. As shown in FIGS. 2 and 3, the head end of the clip and lock members 26 extend well beyond the link 10 of the fencing. As can be seen from FIG. 1, the receptacles 24 are advantageously positioned such that the clip and lock members 26 are located adjacent to a link 10 near the bottom of the fencing. If the slat 16 is attempted to be removed, as by vandals, the head end of the clip and lock member obstructs or hits into the link 10 and prevents ready removal of the slat 16. Vandals will rarely take the time and the chance of being caught to cut the slat 16 or otherwise physically force the clip and lock member 26 from its receptacle 24. With the slats 16 not being easily and quickly removed from the fence, the vandal goes on to some other activity.

A particularly advantageous shape of the clip and lock member 24 is shown in FIGS. 1–5. The illustrated clip and lock member 24 comprises an elongate, thin, substantially planar sheet **26*a*. The width of the sheet 26*a* is such as to fit snugly within the corresponding elongate opening 24 in the slat 16. A flat end portion 26*b* forms the head end of the clip and lock member 26. The flat end portion 26*b* is substantially planar and is attached to the end of the flat sheet 26*a* so as to be substantially perpendicular thereto. The flat end portion 26*b* forms the head of the clip and lock member 26 as illustrated in FIGS. 1–5. Two substantially planar ledges 26*c* project from the sheet 26*a***, with the ledges 26c preferably being in the same plane so as to project from opposite faces of the sheet 26a. The ledges 26c are preferably in a plane which is perpendicular to the sheet 26a. Barbs 26d extend from the sheet 26a, with the barbs being spaced from the ledges 26c. The barbs 26d are advantageously formed by elongate flat extensions which are in planes which form an acute angle to the sheet 26a. The flat extensions forming the barbs 26d must of course slope toward the head end of the clip and lock member 26 to function in the well known action of a barb.

The barbs 26d and the flat ledges 26c of the clip and lock member 26 form together interlocking means which engage the respective receptacles 24 in the slats 16 to interlock the clip and lock member 26 in the slat 16. As can be seen best in FIG. 3, the barbs 26d slide in the opening 24 on one side of the slat 16, and once inside the space in the slat 16, the barbs 26d expand and form an obstruction which prevents the clip and lock member 26 from being withdrawn back through that opening. The flat ledges 26c form an obstruction which will not allow the clip and lock member 26 to move further into the opening 24, and, thus, the clip and lock member 26 is securely locked in place in the opening 24 of the slat 16. The ledges 26c of the clip and lock member could of course be oriented so as to in effect form another pair of barbs opposing the barbs 26d. An advantage of the flat ledges 26c is that when the clip and lock member is positioned in the receptacle 24 of the slat 16, the ledges 26c lie flatwise against the side of the slat 16. The ledges 26c thus prevent the extending portion of the clip and lock member 26 from being bent down along the flat side of the slat 16 so as to pass under the links 10 in the chain link fencing. The flat head portion 26b of the clip and lock member 26 is also resistant to being slid under a link in the fencing even if the extending portion of the clip and lock member 26 is bent down along the flat side of the slat 16. The forward end of the sheet 26a advantageously extends through the opening 24 on the opposite side of the slat 16. Thus, the clip and lock member 26 engages both of the opposite openings 24 in the slat. This improves the stability of the locking mechanism and further aids in preventing bending of the lock and clip member 26.

It should be recognized, of course, that the clip and lock member 26 could be of almost any elongate shape, with the receptacle 24 being shaped to accept longitudinal engagement of the clip and lock member 26. The clip and lock member 26 could have a cross-sectional shape being round, oval, square or any other shape. It simply need be elongate so as to extend into a corresponding receptacle 24 in the slat 16. In all cases, some type of interlocking means is provided for locking the clip and lock member in the receptacle 24 of the slat 16. This is advantageously accomplished with a barb system as described above. It should further be recognized that the slats could be solid in cross section as are conventional wood slats. The receptacle would extend through the slat. The barbs 26d would slip through the receptacle and engage the other side of the slat, while the flat ledges 26c or corresponding barbs would engage the first side of the slat.

Figure 6:
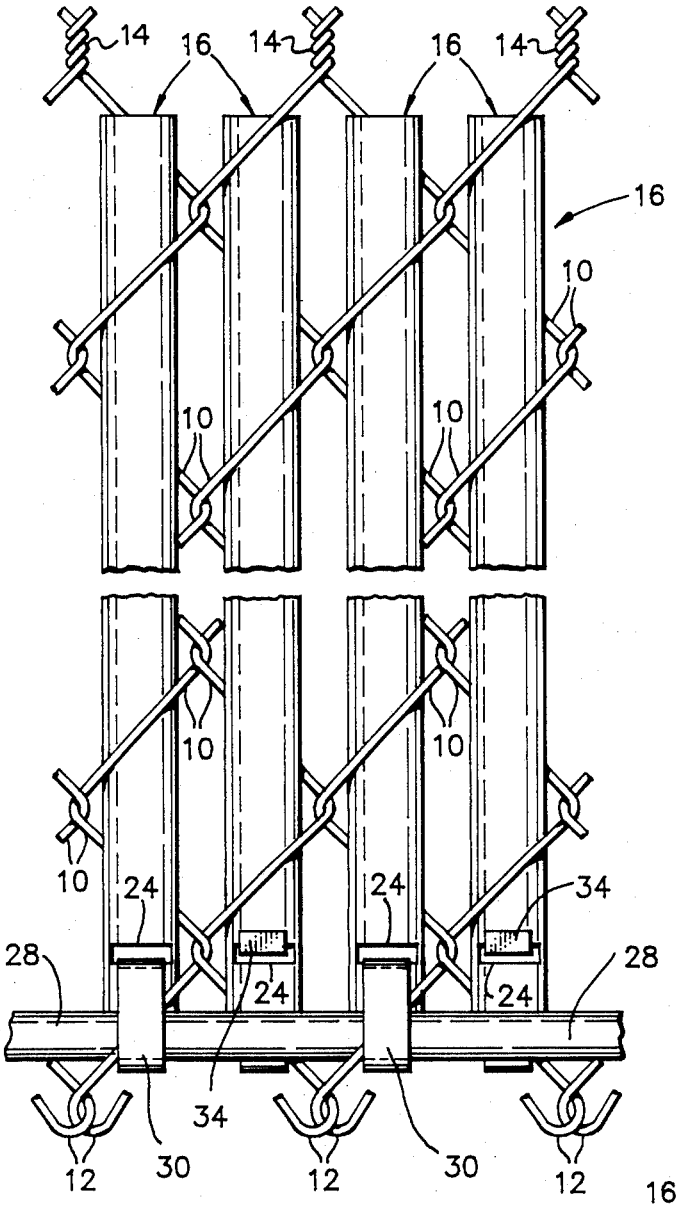
FIG. 6 is a fragmentary view in elevation similar to that of FIG. 1 but showing another novel embodiment of means in accordance with the invention for locking the slats within the chain link fabric of the fence.
Figure 8:
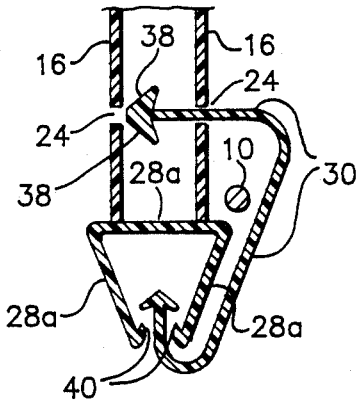
FIG. 8 is a cross-sectional view similar to that of FIG. 7 showing a modified embodiment of the clip and lock member.
Figure 9:
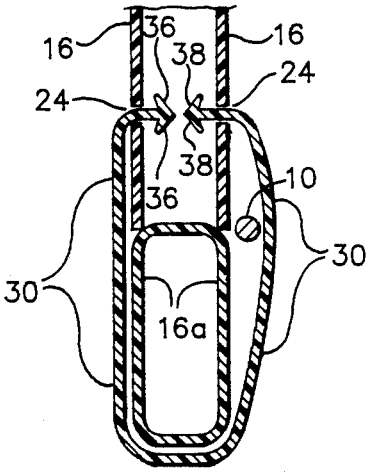
FIG. 9 is a cross-sectional view similar to that of FIG. 7 showing yet another modified embodiment of the clip and lock member.
Figure 10:
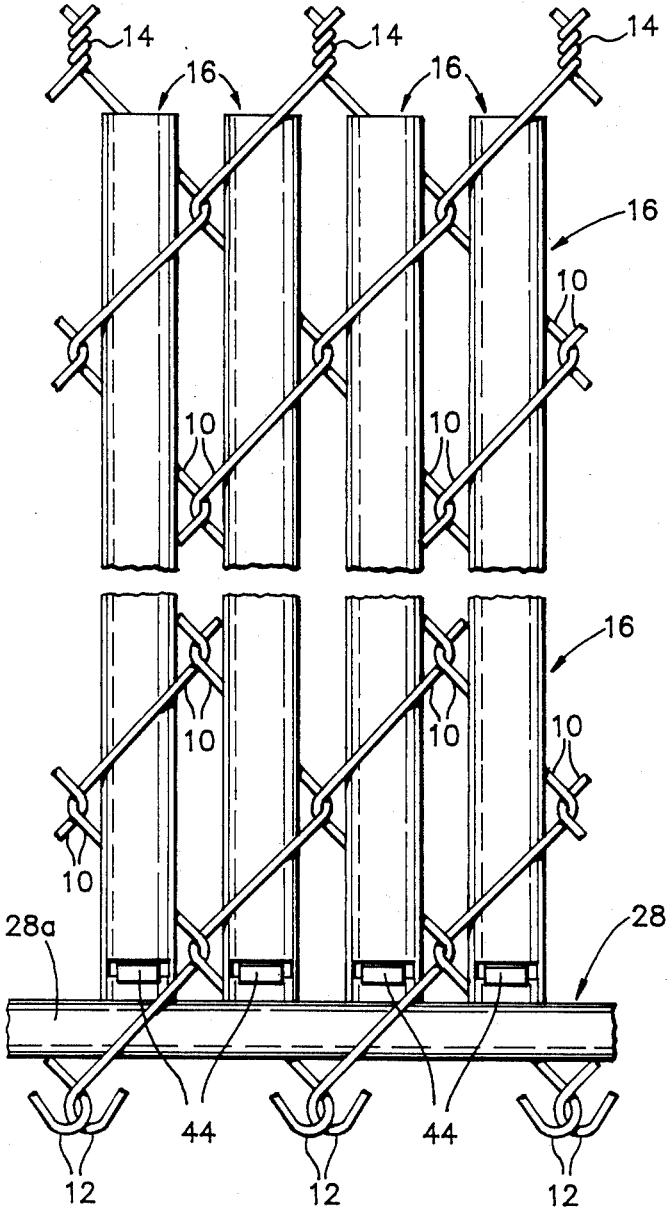
FIG. 10 is a fragmentary view in elevation similar to that of FIGS. 1 and 6 but showing yet another novel embodiment of means in accordance with the invention for locking the slats within the chain link fabric of the fence.
Figure 11:
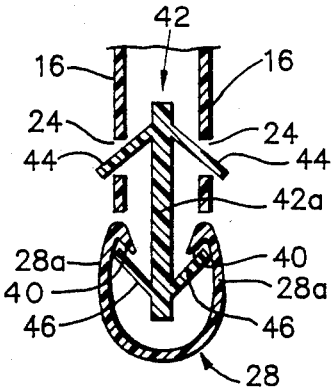
FIG. 11 is a cross-sectional view taken along line 11—11 of FIG. 10.

Other prefered embodiment of means for retaining and locking the slats 16 in the chain link fencing is shown in FIGS. 6–12. In the latter embodiment, a rail 28 is interwoven between consecutive, lower links 10 of the fence such as shown in FIG. 6. The lower rail 28 is quite conventional. See, for example, U.S. Pat. Nos. 4,570,906 and 4,085,954. However, in the present invention, a modified clip and lock member 30 as shown in FIGS. 6–9 and an additional modified clip and lock member 32 as shown in FIGS. 10–12 are provided which interlocks the rail 28. It should be understood that a rail 28 could be used with the system shown in FIGS. 1–5 if so desired, but that the clip and lock member 26 of the embodiment of FIGS. 1–5 would not interconnect the slats 16 with the rail.

Figure 7:
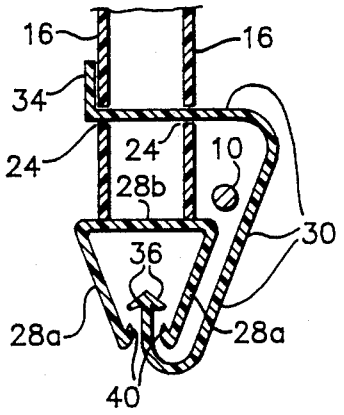
FIG. 7 is cross sectional view taken along line 7—7 of FIG. 6 showing one preferred clip and lock member.

As illustrated in FIGS. 6–9, the clip and lock member 30 comprises an elongate band which is interlocked between the slat 16 and the rail 28 to effectively lock the slat 16 to the rail 28. As shown in FIGS. 6–8, one end of the elongate clip and lock member 30 is engaged and locked into the slat 16. The other end of the clip and lock member 30 engages and is locked into the rail 28. In FIGS. 6 and 7, the elongate clip and lock member 30 comprises a thin band of resilient material. The width of the band is such that the band will fit snugly within an elongate receptacle or opening 24 in the slat 16. One end of the band is provided with a flange 34 extending from the elongate band in an essentially prependicular orientation so as to form a L-shaped end. The L-shaped end of the clip and lock member 30 engages the side of the slat 16 with the remainder of the clip and lock member 30 is extending through the opening 24 in the slat 16. The other end of the elongate band forming the clip and lock member 30 has oppositely faced barbs 36 which engages a receptacle on the rail 28.

As illustrated, the rail 28 comprises an elongate channel member having a cross-sectional shape resembling a triangle in which the legs 28a extend from the base 28b, with the legs 28a sloping towards each other such that the free ends thereof lie parallel to each other in closely spaced, adjacent relationship. The rail 28 is preferably made of a resilient plastic material, but could be made of sheet metal or other resilient material. The base portion 28b of the rail 28 can be essentially flat as shown in FIG. 7, or the base portion 28b can advantageously have a curved surface as shown in FIG. 8. The curved surface bows inwardly from the legs 28a with the curve having a diameter of about $\frac{3}{8}$ to $\frac{5}{8}$ inch. The downward curved surface has been found to be advantageous in supporting the slats 16 in a centered position over the rail 28.

The spaced, elongate edges of the free ends of the legs 28a from the receptacle for accepting the barb 36 at the other end of the elongate band forming the clip and lock member 30. Inwardly projecting lips 40 are advantageously provided on the free ends of the legs 28a to make a positive, locking engagement with the barb 36 on the clip and lock member 30. The lips 40 slope inwardly toward the central portion of the rail 28 to in effect form corresponding barbs or locks for engagement with the barb 36 on the clip and lock member 30. As can be seen from FIGS. 6–8, the clip and lock member 30 can extend over one of the links 10 of the chain link as well as securely lock the bottom end of the corresponding slat 16 to the bottom rail 28. The rail 28 can, of course, not be moved upwardly and downwardly with respect to the fence, and the slats 16 are accordingly locked in place and cannot be removed by vandals.

Instead of an L-shaped end as shown in FIGS. 6 and 7, the end of the clip and lock member 30 which engages the receptacle 24 in slat 16 can be provided with opposite faced barbs 38 which form an arrow head type engagement which slips through the opening 24 and engages the inside surface of the slat inside the opening 24. The barbs 38 are similar to the barbs 36 on the other end of the clip and lock member 30. When the clip and lock member 30 is formed from an elongate band, the barbs 36 and 38 are formed by lips or ledges which slope away from each other and back toward the band forming the clip and lock member 30 so that in cross section the barbs 36 and 38 at the ends of the band have the appearance of an arrow head.

The rail 28 is advantageously made such that its width is about one-half to three-fourths the width of the slats 16. This allows the rail 28 to be used in place of a slat 16 in certain positions along the fence wherein the slat 16 is too wide. Such instances commonly occur at end posts and in gates, wherein a retainer bar is received in the lateral most link of the fence for attachment to clamps on the post or to the sides of the gate. The retainer bar takes up sufficient space that the conventional slat 16 cannot be received in the link of the fence in which the retainer bar is positioned. However, the somewhat smaller rail 28 can be received in such links, and if needed, the legs 28*a* of the rail 28 can be spread apart to fit over the retainer bar in the link of the fence.

The present invention is not limited, however, to the channel type rail 28. As shown in FIG. 9, the rail can be formed by one of the slats 16*a* identical to slats 16 but which is woven between horizontally consecutive lower links of the fence. The vertically positioned slats 16 then rest against the horizontal slat 16*a*. The elongate clip and lock member 30 then preferably has barbs 36 and 38 at the opposite ends thereof. One of the barbs 36 is passed through the receptacle 24 in one side of the slat 16. The elongate clip and lock member 30 then extends downwardly around the slat 16*a* and then upwardly to where the barbs 38 on the other end thereof passes through the receptacle 24 on the other side of the slat 16. The clip and lock member 30 thus encircles the slat 16*a* and generally passes over one of the links 10 in the fence. The end of the slat 16 is then securely locked to the slat 16*a* and cannot be removed from the fence by vandals.

Again, it should be recognized that the clip and lock member 30 could be of almost any elongate shape, with the receptacle 24 being shaped to accept longitudinal engagement of the clip and lock member 26. The clip and lock member 30 could have a cross-sectional shape being round, oval, square or any other shape. It simply need be elongate so as to extend between the receptacle 24 in the slats 16 and a corresponding receptacle in the rail 28 as shown in FIGS. 6–8 or between the receptacle 24 on one side of the slat 16, around the bottom rail to the receptacle 24 on the other side of the slat 16 as shown in FIG. 9.

A somewhat modified embodiment of the rail 28 and slat 16 arrangement of FIGS. 6–9 is shown in FIGS. 10–12. In the embodiment shown in FIGS. 10–12, the rail 28 is inverted such that the free ends of the sides 28*a* extend upwardly towards the slats 16, and the slats 16 actually rest on the upwardly extending ends of the sides 28*a* of the rail 28.

The slats 16 are virtually the same as those of the embodiment of FIGS. 1–6 with the exception that the elongate openings or receptacles 24 as shown in FIG. 12, are located closer to the bottom end of the slats 16. Generally, the receptacle 24 of the embodiment of FIGS. 10–12 will be located within about one-eighth to one inch from the bottom of the slat 16.

The clip and lock member 42, as best illustrated in FIG. 11, is very similar to the clip and lock member 26 of FIGS. 1–6, with the exceptions that two opposing pairs of barbs 44 and 46 are positioned at the opposite ends of the thin planar sheet portion 42*a*. The pairs of barbs 44 and 46 slope outwardly and toward the central portion of the sheet portion 42*a*. The end of the sheet member 42*a* of the clip and lock member 42 containing the barbs 44 is pushed through the open bottom end of the slat until the barbs 44 engage and extend through the opposite receptacles 24 in the slat 16. The barbs 44 are of sufficient length that they will extend through and from the receptacles 24 as shown in FIG. 11.

The other end of the sheet member 42*a* of the clip and lock member 42 containing the barbs 46 is pushed into the space between the free ends of the sides 28*a* of the rail 28 until the barbs 46 engage with the lips 40 on the free ends of the sides 28*a* of the rail 28. The elongate clip and lock member 42 thus effectively secures the slat 16 and the rail 28 together such that the slat 16 cannot be removed from the rail 28 or the links 10 in the fence.

It is to be understood that the present disclosure, including the detailed description of preferred embodiments, is made by way of example and that various other embodiments are possible without departing from the subject matter coming within the scope of the following claims, which subject matter is regarded as the invention.

I claim:

1. In chain link fencing of the type including a plurality of elongate slats which are woven flatwise through the links of the chain link fabric of the fencing in spaced, parallel arrangement, an improvement in means for retaining and locking the slats within the fencing, said improvement comprising a receptacle formed at a uniform position in each of the elongate slats;

an elongate member engaging each receptacle, said elongate member being supported entirely by said slat, with the elongate member extending from at least one side of the slat such that the elongate member forms a lock pin which obstructs the chain link fencing if the slat containing said elongate member is moved upwardly or downwardly, whereby the slats are locked into the chain link fencing at uniform positions along the fencing; and interlocking means on each elongate member, said interlocking means engaging with the respective receptacle in said slat to connect said elongate member to said slat within said receptacle in said slat, whereby said elongate member is supported entirely by said slat.

2. The improvement in chain link fencing in accordance with claim 1, wherein said interlocking means comprises one or more barbs on each of said elongate members.

3. In chain link fencing of the type including a plurality of elongate slats which are woven flatwise through the links of the chain link fabric of the fencing in spaced, parallel arrangement, an imporvement in means for retaining and locking the slats within the fencing, said improvement comprising a receptacle formed at a uniform position in each of the elongate slats;

an elongate member engaging each receptacle, with the elongate member extending from at least one side of the slat such that the elongate member forms a lock pin which obstructs the chain link fencing if the slat containing said elongate member is moved upwardly or downwardly, whereby the slats are locked into the chain link fencing at uniform positions along the fencing; and interlocking means on each elongate member, said interlocking means comprising one or more barbs on each of said elongate members, said barbs engaging with the respective receptacle in said slat to interlock said elongate member in said slat, and further wherein each said receptacle on said slat comprises an elongate opening;

each said elongate member has the form of an elongate, thick, substantially planar sheet in which the width of the elongate sheet is such as to fit snugly within the corresponding elongate opening is said slat; and the barbs extend from the opposite flat sides of said planar sheet to engage the elongate opening in said slat and interlock with the slat.

4. The improvement in chain link fencing in accordance with claim 1, wherein the elongate slats have a hollow, flattened, tubular shape.

5. In chain link fencing of the type including a plurality of elongate slats which are woven flatwise through vertically consecutive links of the chain link fabric of the fencing in spaced, parallel arrangement, an improvement in means for retaining the slats at uniform positions along the fencing and of locking the slats in such positions, said improvement comprising a receptacle formed adjacent to the lower end of each of the elongate slats;

an elongate rail woven between horizontally consecutive lower links of the chain link fabric of the fencing, such that the lower ends of the elongate slats rest upon the elongate rail; and an elongate clip and lock member having one end engaged in locking engagement with the receptacle in said slat, and having the portion of said clip and lock member extending from said one end thereof engaged in locking engagement with said elongate rail.

6. The improvement in chain link fencing in accordance with claim 5, wherein the portion of said clip and lock member extending from said one end thereof encircles said rail and the other end of said clip and lock member extends back to and engages in locking engagement with the receptacle in said slat.

7. The improvement in chain link fencing in accordance with claim 6, wherein interlocking means are provided on each of the ends of said clip and lock member with the interlocking means engaging with said receptacle in said slat.

8. The improvement in chain link fencing in accordance with claim 7, wherein the interlocking means comprises one or more barbs on each of said ends of said clip and lock member.

9. The improvement in chain link fencing in accordance with claim 5, wherein a second receptacle is formed in said rail and the other end of said clip and lock member is engaged in locking engagement with said second receptacle.

10. The improvement in chain link fencing in accordance with claim 9, wherein said rail has the shape of an elongate channel in which two legs extend from a base, with the legs sloping toward each other and with the free ends of said legs lying adjacent each other in parallel, spaced position to form an elongate, narrow opening between said free ends of said legs, said narrow opening comprising said second receptacle.

11. The improvement in chain link fencing in accordance with claim 10, wherein elongate lips extend inwardly from the free ends of said legs toward the central portion of said elongate channel, and the other end of said clip and lock member is provided with at least one barb which passes through said second receptacle and engages in locking engagement with said lips on the free ends of said legs of said channel.

12. The improvement in chain link fencing in accordance with claim 11, wherein said channel faces upwardly with the slats resting on the free ends of said legs of said channel;

said slats have a hollow, flattened, tubular shape;

said receptacle is formed by a pair of aligned openings in the opposite flat sides of said slats;

said one end of said clip and lock member has opposite barbs provided thereon;

said one end of said clip and lock member is inserted into the open lower end of said slat until the opposite barbs on said one end engage with the pair of aligned openings in said slat; and the other end of said clip and lock member extends downwardly such that the barb thereon engages in locking engagement with said lips on the face of said legs of said channel.

13. The improvement in chain link fencing in accordance with claim 5, wherein the upwardly facing portion of said rail comprises a curved surface which curves inwardly and downwardly to form a trough-like support for the lower ends of the elongate slats.

14. The improvement in chain link fencing in accordance with claim 13, wherein the curved surface of said rail has a radius of between about 3/16 and 5/16 inch.

15. The improvement in chain link fencing in accordance with claim 1, wherein there is further incorporated an elongate rail woven between horizontlly consecutive lower links of the chain link fabric of the fencing such that the lower ends of the elongate slats rest upon the elongate rail.

16. The improvement in chain link fencing in accordance with claim 5, wherein the upwardly facing portion of said rail comprises a curved surface which curves inwardly and downwardly to form a trough-like support for the lower ends of the elongate slats.

* * * * *